US005594410A

United States Patent [19]

Lucas et al.

[11] Patent Number: 5,594,410

[45] Date of Patent: Jan. 14, 1997

[54] EMERGENCY WARNING ESCAPE SYSTEM

[76] Inventors: Michael Lucas, 5223 Forest Hill Drive, Mississauga, Ontario, Canada, L5M 5B2; James M. Klotz, 355 Clinton Street, Toronto, Ontario, Canada, M6G 2Y7; Frank Farfan, 2414 St. Frances Drive, Burlington, Ontario, Canada, L7P 3Y2; S. Warren Hall, 3 Cranleigh Court, Etobicoke, Ontario, Canada, M9A 3Y2

[21] Appl. No.: 442,474

[22] Filed: May 16, 1995

Related U.S. Application Data

[63] Continuation of Ser. No. 112,082, Aug. 26, 1993, abandoned.

[51] Int. Cl.[6] ..... G08B 5/00

[52] U.S. Cl. ..... 340/332; 340/328; 340/628; 340/691

[58] Field of Search ..... 340/628, 691, 340/692, 693, 331, 332, 329, 328

[56] References Cited

U.S. PATENT DOCUMENTS 4,276,542 6/1981 Russ ..... 340/331 X
4,717,910 1/1988 Scripps et al. ..... 340/691 X
4,730,184 3/1988 Bach ..... 340/691
4,801,928 1/1989 Minter ..... 340/332 X
5,177,461 1/1993 Budzyna et al. ..... 340/628 X
5,293,155 3/1994 Nicol et al. ..... 340/692 X

*Primary Examiner*—Brent A. Swarthout
*Assistant Examiner*—Edward Lefkowitz

[57] ABSTRACT

An enhanced emergency warning and escape system is taught. The system can advantageously be combined with existing smoke or fir detector technology to share detection technology and activate additional electrical equipment for improving or simplifying the escape or emergency condition. As part of the system, an electrical switch, which is used under normal circumstances for an electrical device (such as a light fixture), is automatically activated when a detection occurs. A remote control device also allows user activated alarm conditions where, preferably, a smoke detector produces an alarm which can be distinguished from a fire alarm.

10 Claims, 3 Drawing Sheets

EMERGENCY WARNING ESCAPE SYSTEM

The present application is a continuation of abandoned application Ser. No. 08/112,082, filed Aug. 26, 1993, now abandoned.

BACKGROUND OF THE INVENTION

The present invention relates to an emergency warning and escape system for a dwelling which can be easily added thereto.

Portable smoke detectors are extremely common for retrofitting dwellings and significantly improve the likelihood of successfully leaving the building or dwelling if a fire or smoke condition exists. These systems can operate on a number of principles but basically detect small particles of smoke and produce an audible alarm allowing the occupants to be alerted to the possible danger and make a suitable escape. These systems have been particularly valuable when a fire occurs at night as the occupants otherwise may be asleep and do not detect the smoke as early as they would have if they were awake.

More recently a fire detector has been introduced which again is a portable unit but has built directly therein a small halogen light source which has its own battery supply. When an alarm condition is sensed the light source is activated and provides light at least adjacent the smoke detector to assist people in finding the escape route.

There is also more sophisticated fire alarm systems wherein the smoke detector alarm is sensed by a circuit associated with an auto dial telephone and the fire department or a remote alarm monitoring service is directly called if an alarm condition occurs. This type of system is somewhat similar to intruder detection systems which are hooked up to a central monitoring service. Unfortunately for many applications, these complicated or sophisticated systems are too expensive and problems can occur due to false alarms and improperly having the fire department attend at the site.

There remains a need to provide an effective warning system which is easy to install, is relatively inexpensive and improves the effectiveness of the system.

SUMMARY OF THE INVENTION

An emergency warning and escape system for a dwelling according to one aspect of the invention comprises in combination a smoke detector which produces an alarm signal upon a detection of smoke and cooperates with an electrical switch, which in its normal mode is connected to the power supply of the dwelling and activates and deactivates current flowing to an electrical device, such as a light fixture. The electrical switch includes means for sensing when the alarm signal of the fire detector has been activated and upon sensing of this condition, the switch automatically moves or remains in the activated position causing current to flow to the electrical device. In this way, for example, a light fixture controlled by the electrical switch can be activated to provide illumination. A particular light fixture would preferably be chosen to provide effective lighting for the escape route. Therefore, the system takes advantage of existing controlled light fixtures which are connected to the power supply of the dwelling to provide a more efficient system. Such light fixtures are not tied to the position of the smoke detector and several light fixtures may be activated to define a more complete escape route.

According to a preferred aspect of the invention, the electrical switch in the emergency state can have associated therewith a pulsing circuit to pulse the current to the light fixture. This embodiment is particularly suited for a light switch associated with a front door light fixture or other outdoor fixture. In this way the emergency personnel (fire department, police, ambulance, etc.) who are trying to respond to an emergency call will see a flashing outdoor light fixture at the location of the alarm and thus be able to more quickly respond. This pulsing mode can also be manually activated for an emergency condition other than a sensed smoke condition.

According to yet a further aspect of the invention, a number of different electrical switches can be installed which all respond to the sensing of an alarm condition. However, the timing or rate of pulsing can be controlled to provide a sequence of pulses and thus provide guidance with respect to the direction of exit. For example, one light fixture may come on followed by the following light fixture followed by a third light fixture and, for example, returning to the first, or a light fixture closer to the exit may pulse more quickly than one further away.

It is preferred to have the smoke detector produce its own unique coded wireless FM signal, for example, for activation of the electrical switches. The electrical switch is basically constantly listening for this signal and although there is current draw on this it is relatively small and in any event the switch is connected to the power supply of the dwelling and this is not a particular problem. It is also possible that the electrical switch may respond in other manners. For example, the switch could merely recognize the audible sound of the smoke detector or a portion of the signal and be activated in this manner. The switch could also be handwired to the detector (either through household AC lines or through dedicated wiring) and an electrical signal be used for communication purposes.

It is also possible to provide a retrofit system for existing smoke detectors where a connection is made across the 9 Volt battery of the smoke detector which is fed to a separate signal producing unit which can be directly associated with the smoke detector. There is a large current draw difference between the smoke detector in its stand-by mode monitoring for smoke particles relative to the draw when the alarm system is activated. The difference in these modes can be detected and/or the actual large current draw can cause activation of the second circuit sitting in parallel therewith. This second circuit will produce or can produce the unique signal. Therefore, the system can include a retrofit for existing smoke detectors or the smoke detector can include the separate signalling means directly therein.

The pulsing feature of the electrical switch can be built into all switches and adjustable such that, if the user does not wish, the pulsing mode may not be activated or specialized pulsing switches can be provided. The specialized pulsing switch preferably has a manual override to the pulsing mode whereby in an emergency condition, such as a medical emergency, the user merely activates the switch to its pulsing mode manually rather than being alarm activated to provide easy identification of the location of the emergency condition. This is particularly valuable for police, fire departments, medical personnel or other emergency personnel.

According to yet a further aspect of the invention, the alarm system includes a separate alarm mode which can be manually activated by a portable remote control. Preferably, a distinctly different audible alarm mode is provided. For example, it could be a pulse mode of the normal fire alarm or it could include its own separate audible sound generator which alarm might be activated manually. For example, in a medical emergency condition, the person could manually activate the alarm to alert other occupants of the house of the medical condition. Furthermore, this separate signalling mode could be activated manually by an occupant in the case of possible detection of an intruder. This secondary mode can still be coordinated with the light fixtures, if desired, to activate the various switches. It is felt that a separate signal source is the best embodiment in that it allows differentiation between a fire alarm condition, smoke alarm condition and an occupant activated alarm condition. It is felt that it would not be desirable to produce the identical fire alarm condition in case of a possible intruder, as the normal reaction, if the fire alarm is produced, is to try to exit the building quickly and this may result in direct confrontation with the intruder. In the case of an intruder situation, the separate alarm going off would merely alert the occupants and also alert the intruder encouraging the intruder to leave. The generation of the alarm as well as the turning on of lights would obviously encourage the intruder to leave the dwelling. In some embodiments a single alarm signal could be used, however, it is felt that this would be less desirable and provide potential problems. It is also possible merely to activate the light fixtures controlled by the electrical switches in the case of a possible intruder.

BRIEF DESCRIPTION OF THE DRAWINGS

Preferred embodiments of the invention are shown in the drawings wherein.

DETAILED DESCRIPTION OF THE PREFERRED EMBODIMENTS

Figure 1:
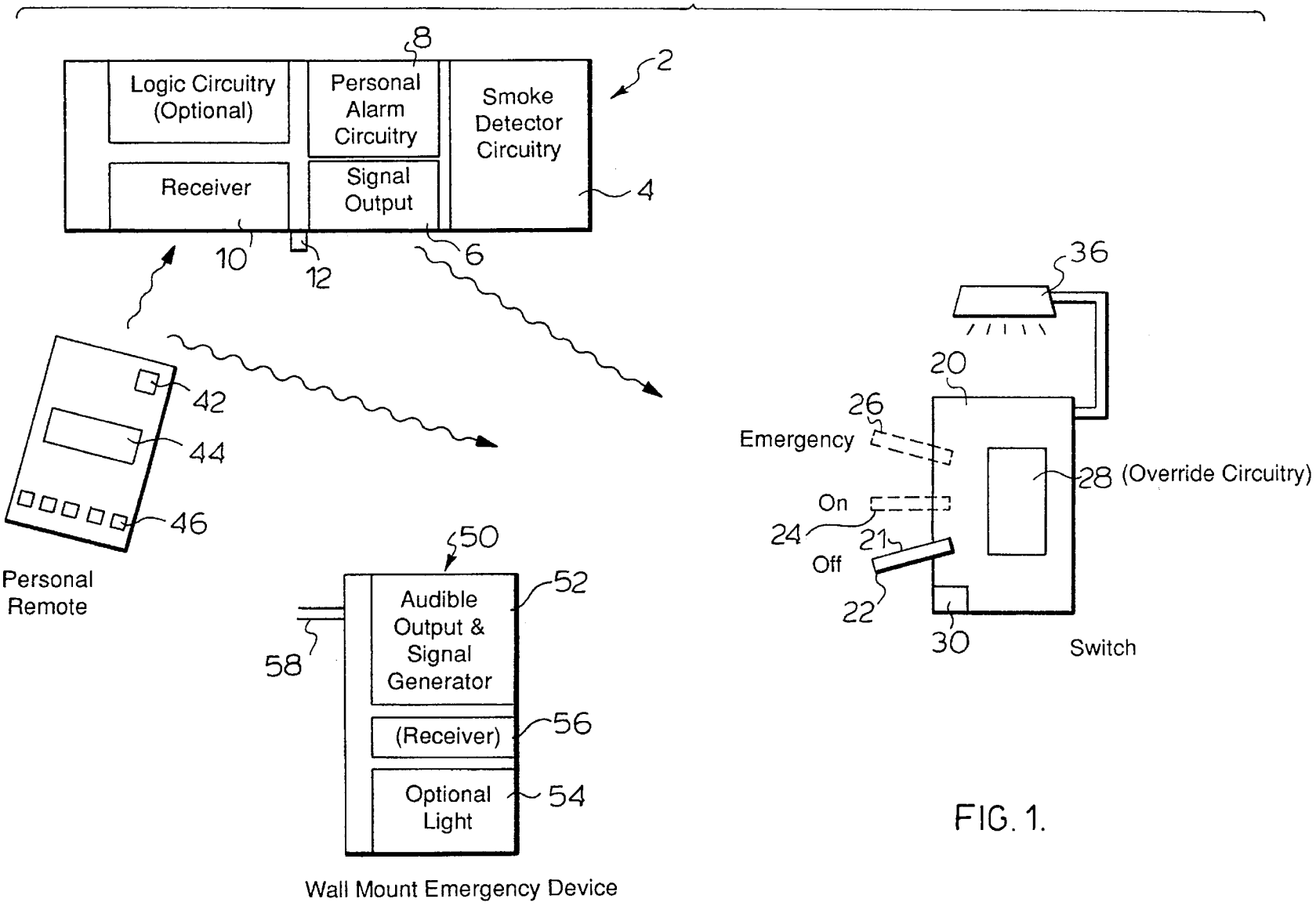
FIG. 1 is schematic showing a modified smoke detector, personal alarm in combination with a personal remote, the electrical switch and an optional wall mount emergency unit.

The modified smoke detector 2 has smoke detecting circuitry 4 of the conventional type which detects the presence of smoke or a fire condition. When an alarm condition is sensed, the smoke detector produces a first alarm output which indicates a smoke or fire condition. The actual signal being processed by the alarm circuitry 8 and the audible and/or other output is produced by the signal output device 6. The alarm circuitry 8 can also control the signal output 6 to produce a second type of alarm and for convenience this will be called a personal alarm which might be for a medical condition or intruder condition or other condition. The purpose is to alert the occupants of a possible condition in the home in addition to detection of a fire condition. The modified smoke detector 2 includes a receiver 10 (preferably, FM, but other signals such as infrared could be used as well), which, in the preferred mode, can receive a signal from a personal activation device generally shown as 40, in this case, remote control 40, which is portable. When the receiver 10 receives the signal from the personal remote 40, it activates the secondary alarm mode.

In addition, the personal remote may include a smoke detector test mode button 42 which allows remote testing of the smoke detector for determining whether it is operating satisfactorily. This is similar to the manual test button 12 which is commonly present on existing smoke detectors. It is believed that the personal remote 40 is more convenient and would allow the householder to more frequently test the device and thus make sure it is operating satisfactorily. One of the major problems with portable smoke detectors is when the batteries have been removed or the batteries are dead, and therefore, the device does not function. However, the mere fact that the smoke detector is physically present, the occupants may believe that it is operating.

Figure 3:
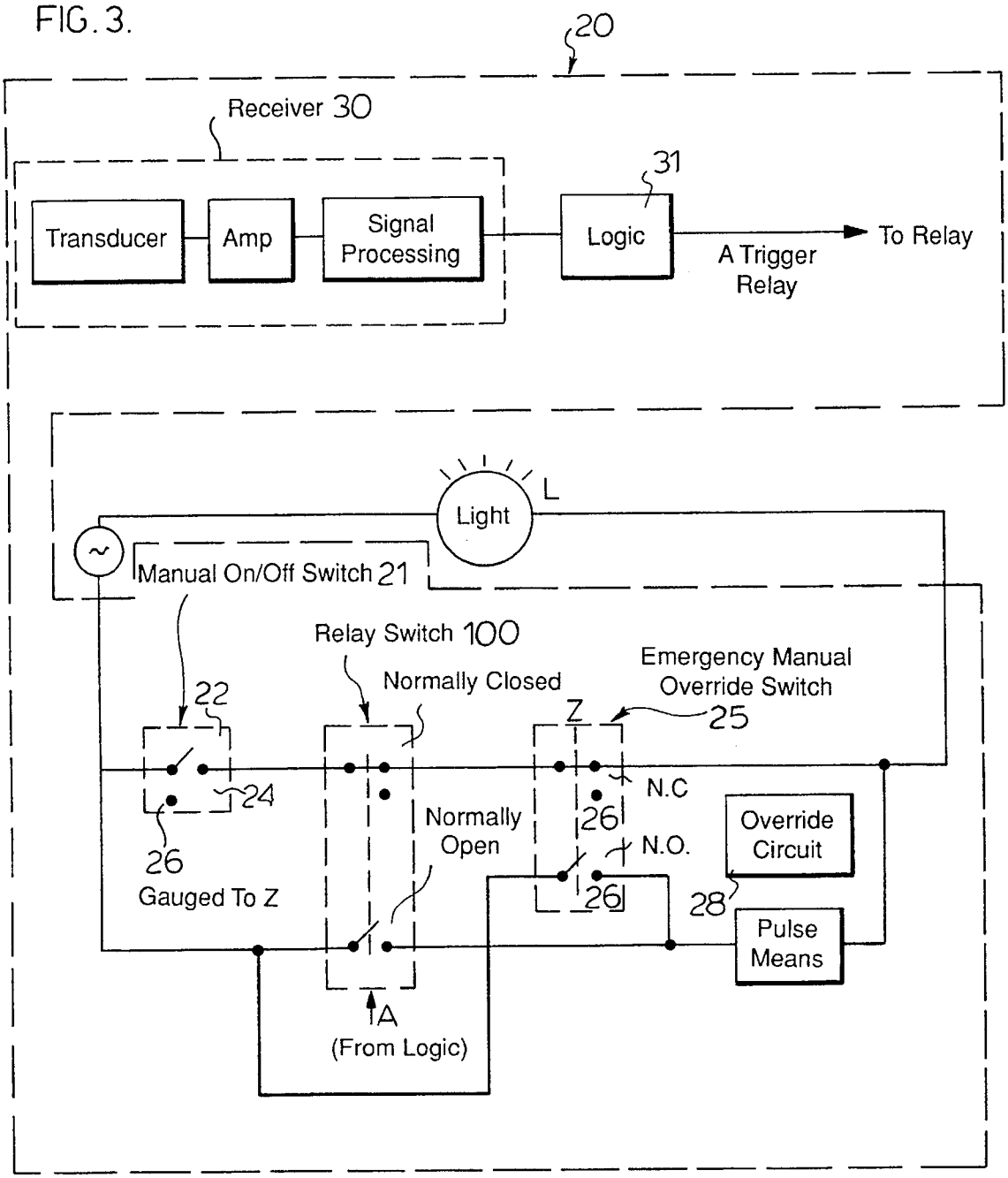
FIG. 3 shows one embodiment of an electrical switch according to the invention.

The modified smoke detector 2 cooperates with an electrical switch device, shown generally as 20, which in the preferred form is a wall mount switch which replaces an existing manual switch for controlling a hard wired light fixture. Switch device 20 is shown in more detail in FIG. 3. The electrical switch 20 has a toggle member 21 which is shown in OFF position at 22 in a normal manual ON position at 24 and in an emergency mode position indicated as 26 ganged to close the circuit in a parallel path through switch 25. In most cases, the toggle 21 will be in the OFF or the ON position. However, under certain circumstances, it may be desirable to move to the emergency position 26. The electrical switch 20 also includes a receiver 30 (including such transducers, amplifiers and signal processing circuitry as would be appropriate) for receiving a signal output from signal output device 6. In addition, switch 20 includes logic means 31 to determine whether an alarm condition has caused activation of the smoke detector and to generate a switching signal A. This could be either the signal indicative of a fire condition or the signal indicative of condition other than a fire. Upon detection of such signal logic 31 generates switch signal A which triggers relay 100, thereby closing the circuit in a path parallel to the path through manual switch 21. It will be appreciated that the actual toggle member 21 could be in the OFF position or in the ON position and therefore the overall circuitry does not rely on moving of the toggle switch. It merely activates the switch 20 electronically. The purpose of the emergency position 26 is to allow manual activation of the emergency condition. This manual activation is appropriate in certain circumstances, for example, when the electrical switch 20 controls an outdoor front door light L, for example. In the emergency position the front door light is turned on and it preferably is operated in a pulsing mode controlled by the override circuitry 28. Thus a pulsing front door light can be activated either by sensing of the alarm condition or by turning on of the switch 21,25 to the manual emergency position 26. This is particularly advantageous in that it allows the home owner to manually activate the switch if the police or the fire department or medical personnel have been called and provide an additional manner of alerting these people to the particular location in which the emergency condition exists. The pulsating position is also automatically provided for this switch upon detection of the signal from the smoke detector.

The electrical switch 20 in some applications does not require the manual override position 26 nor does it require the pulsing mode. For example, the electrical switch may merely control a light fixture in a hall way and in this case the switch could merely respond to the detection of an output signal or activation signal either from the smoke detection signal or the personal remote and turn the light fixture on or maintain it in the ON position. The switch 20 circuitry could reset itself upon any manual operation of the toggle switch 21. It is also possible to have the override circuitry 28 operate in a pulse mode which can be manually set. This has advantages where a number of lights are to be controlled and these lights are pulsed at different rates to provide a sequence starting and at one end of the light fixtures and moving to the other end. Thus a pulsing type light signal can indicate the direction of exit and can assist people in possible situations where there might be some accumulation of smoke and disorientation with respect to the proper escape direction.

The remote control 40 in addition includes a personal alarm activation key 44 which when activated can either directly activate the electrical switch 20 or can activate the smoke detector to cause it to produce an output signal which in turn activates the electric switch. In addition, a number of programming keys 46 have been provided to allow discrimination between different functions of the personal remote. These programming keys could cause activation of the smoke detector on its own or activation of the switch 20 on its own or certain switches 20 on their own or just distinguish between switches and/or allow both the smoke detector and switches to be activated.

FIG. 1 also illustrates a wall plug unit 50. This unit includes its own noise or audible alarm generator 52 and optionally can include a light source 54. The unit includes its own receiver 56 which can either be activated by the smoke alarm or personal alarm signal. In addition, this device can act as a relay device sending a relayed signal, either a relayed FM signal or a relayed signal over the hard wiring of the house. The wall plug is plugged into a wall receptacle by the male plug 58. This optional wall mount unit can respond to a detection of smoke by the smoke detector 2 and/or can respond to signals from the personal remote 40. This wall mount unit can also be used to control a lamp which is maintained in an operating condition (i.e. in the ON position). A further feature of personal remote 40 is that it can be provided with its own clock or timing arrangement, and therefore, can extend the signals to the various electrical switches and the optional wall mount plug in at 50 based on a time sequence. With this arrangement it is possible to program the remote controller to program the individual devices and cause the activation thereof. This would not be typically used for an emergency type condition but merely to control certain lights in a predetermined manner. It can be recognized that various forms of remote controllers of the present invention can be provided to the public from a very simple unit which merely acts as remote smoke detector tester and personal alarm activation, to a device which includes more sophisticated timing embodiment described above.

Figure 2:
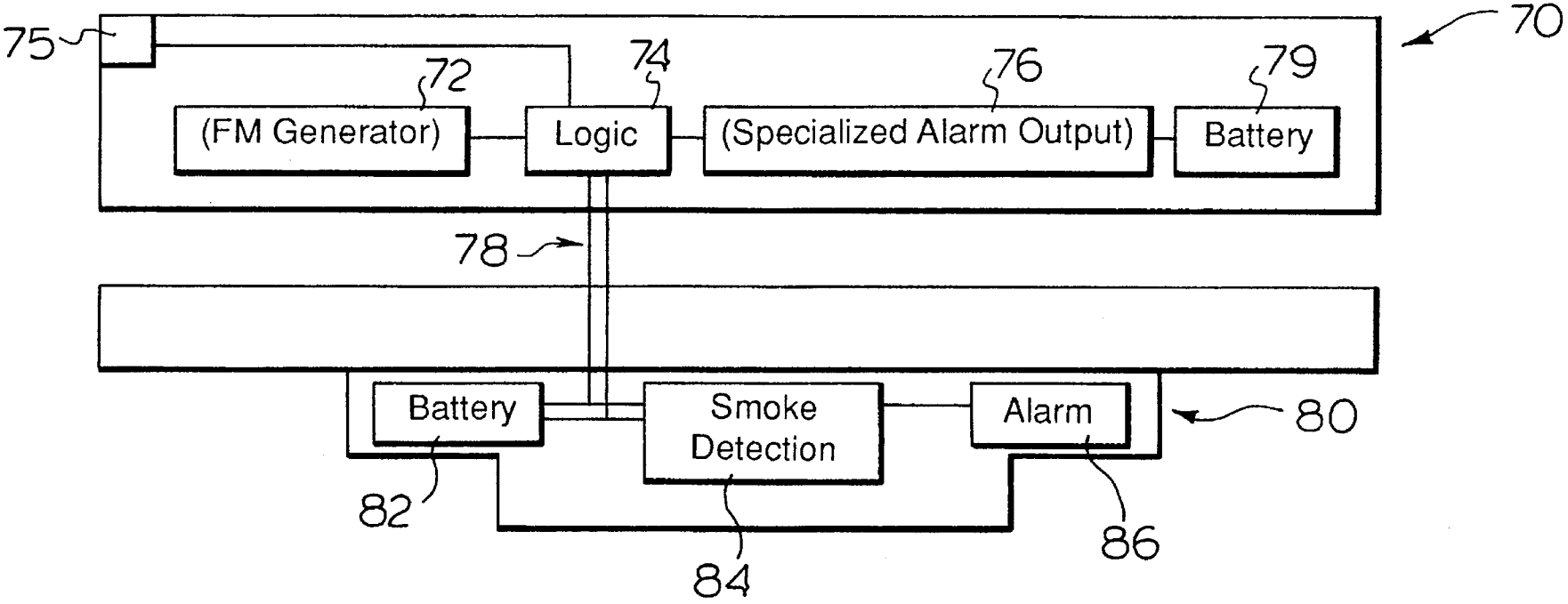
FIG. 2 shows a schematic of one method of adapting existing smoke detectors to function in the additional manner.

A further aspect of the invention is shown on FIG. 2 where a conventional smoke detector 80 merely produces an audible alarm, such as from a loudspeaker, indicated as 86. This conventional smoke detector has a battery 82 and smoke detection circuitry 84. A separate wire connection 78 is made between the battery 82 and the smoke detection circuitry 84. This connection can be made in parallel with the normal circuitry connecting the battery to the smoke detection circuitry. The purpose of the connection via the wire connection 78 is to sense when the smoke detector has gone into an alarm condition. This condition can be sensed due to the much higher current draw in the alarm condition mode in contrast to the very low current draw when it is in its sensing mode. The circuit logic 74 of the separate insert base 70 detects the large current differential, and when this large current differential is present, recognizes that an alarm condition is present. The circuitry 74 can then cause activation of a signal generator, such as FM transmitter 72, which produces a signal for activating the electrical switch 20 or the optional wall mount plug unit 50. The insert base 70 can include its own power supply 79 or it could rely on the battery 82 of the smoke detector, as it would only draw significant power under an alarm condition and then only for as long as is necessary to trigger switch 20 or wall mount plug unit 50. The insert base 70 can include its own signal receiving capability indicated as 75 for coordination with the remote control 40. The structure of FIG. 2 allows for convenient retrofit with existing smoke detectors. An existing smoke detector may be taken down from the ceiling and the insert base 70 is mounted in its place. The conventional smoke detector is then mounted to the insert base 70. The lead 78 can be non-intrusive and basically merely fit between the contact of the battery with the circuitry. In this way the user can easily make this connection for the retrofit or coordination of the smoke detector with the insert base. In some cases, the smoke detector 80 may include additional ports for connecting with other equipment. These ports typically produce a signal when an alarm has been produced. Therefore, the insert base 70 and the electrical wire connection 78 could go directly to these ports as opposed to being placed intermediate and in parallel with the battery 82 and the smoke detection circuitry 84. The arrangement of FIG. 2 provides a convenient method for retrofitting existing systems where the user at this time does not wish to replace the smoke detector. It is also possible to have the insert base designed as a separate unit which is mounted beside portable smoke detector.

The electrical switch 20 can be programmed to work with handwired smoke detectors, with the activation signals being transmitted through the hard wires.

The system can also operate using a dual technology signalling arrangement. For example, the detector produces both an audible signal and an FM signal. The electrical switch is then provided with two receivers, one for each signal type and the switch is activated only upon confirmation of receipt of both signals. This has the advantage of reducing false alarms due to spillover, i.e. receipt of a signal from an adjacent system (neighbour, etc.), as one signal of the signals (in this case the audible signal) can be a specific local signal having a small transmission distance. Furthermore, the care in evaluating either signal by frequency or power can be reduced, as improper sources of one signal type does not produce an alarm unless confirmed by the second source.

According to a further embodiment of the invention, the activation of one detector can cause other detectors to also produce an alarm signal. In this case, the detectors include a receiver as shown in FIG. 1 and receipt of a signal from a detector is preferably distinguished from the signal from the personal remote control. Each detector can also include logic to maintain the reason for activation (i.e. detection of a particular alarm condition or in response to an alarm signal being received which originated at a different detector). This is advantageous as all alarms are activated, reducing the possibility of the alarm condition going unnoticed. Furthermore, the audio signal would be increased. With this arrangement, a signal from the personal remote would cause all detectors to cease the alarm signal other than the originating detector. The personal remote can also allow programming of these features for each detector or a manual adjustment can be provided.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. An emergency warning and escape system comprising in combination a detector/alarm arrangement that produces a first audible alarm signal upon detection of smoke or a combustion condition and means for receiving a separate signal from a remote control unit and producing an audible second alarm signal upon reception of the signal from said remote control unit; said second signal being easily distinguished from said first signal; said remote control unit includes a manually activated signal generating and transmitting arrangement to activate said detector/alarm arrangement causing the same to produce said audible distinct second alarm signal, and including an electrical switch which can be operated in a normal mode or an emergency mode, said electrical switch activates and deactivates current flow to a light fixture arrangement associated therewith, said electrical switch includes means for sensing when the first alarm signal or the audible distinct second alarm signal of the detector has been activated and upon sensing of this condition the switch operates in an emergency mode and automatically moves or remains in the activated condition causing current to flow to the light fixture for powering thereof.

2. An emergency warning and escape system as claimed in claim 1 wherein said switch in said emergency mode includes a current pulsing arrangement which pulses the current to the light fixture whereby the light fixture produces pulsed illumination.

3. An emergency warning and escape system as claimed in claim 1 wherein said electrical switch includes a manual arrangement for causing said switch to operate in the emergency mode.

4. An emergency warning and escape system as claimed in claim 2 wherein said electrical switch includes a manual adjustment for varying the start time or the frequency of the pulsed current.

5. An emergency warning and escape system as claimed in claim 3 wherein the electrical switch includes a manual adjustment for controlling the current pulsing arrangement to allow a non pulsed current flow or a pulsed current flow.

6. An emergency warning and escape system as claimed in claim 4 wherein said system includes more than one said electrical switch, with said switch having its said manual adjustment differently adjusted whereby the lights associated with said switches can be differentiated from each other to define an exit direction from the premises.

7. An emergency warning and escape system for premises having electrical power distributed by electrical wiring comprising in combination:

a detector arrangement that produces a remote, activation signal and an audible alarm upon detection of smoke or combustion conditions, an electrical wall mount-type switch which can be operated in a normal mode or in an emergency mode and is connected to the electrical wiring of the premises and activates and deactivates current flow to a light fixture through said electrical wiring, wherein said electrical switch is located remote from said detector and said light fixture and said light fixture is located remote from said detector, means for communicating said activation signal to the electrical switch, and wherein said electrical switch includes means for sensing said activation signal and upon sensing said signal the switch operates in an emergency mode and automatically moves or remains in the activated condition causing electrical current to flow to said light fixture.

8. An emergency warning and escape system as claimed in claim 7 wherein said activation signal comprises an electromagnetic signal.

9. An emergency warning and escape system as claimed in claim 8 wherein said electromagnetic signal is a radio frequency signal.

10. An emergency warning and escape system as claimed in claim 9 wherein said radio frequency signal is a frequency modulated radio frequency signal coded to uniquely identify said detector arrangement.

* * * * *